US008249480B2

(12) United States Patent
Aslam et al.

(10) Patent No.: US 8,249,480 B2
(45) Date of Patent: Aug. 21, 2012

(54) FUSING APPARATUS FOR HIGH SPEED ELECTROPHOTOGRAPHY SYSTEM

(75) Inventors: Muhammed Aslam, Rochester, NY (US); James D. Shifley, Spencerport, NY (US); Robert D. Bobo, Ontario, NY (US)

(73) Assignee: Eastman Kodak Company, Rochester, NY (US)

( * ) Notice: Subject to any disclaimer, the term of this patent is extended or adjusted under 35 U.S.C. 154(b) by 382 days.

(21) Appl. No.: 12/491,320

(22) Filed: Jun. 25, 2009

(65) Prior Publication Data

US 2010/0329708 A1 Dec. 30, 2010

(51) Int. Cl.
*G03G 15/20* (2006.01)

(52) U.S. Cl. ..... 399/69; 399/329

(58) Field of Classification Search ..... 399/329, 399/323, 67, 69

See application file for complete search history.

(56) References Cited

U.S. PATENT DOCUMENTS

| | | | | |
|---|---|---|---|---|
| 3,983,287 | A | 9/1976 | Goossen et al. | |
| 4,791,275 | A | 12/1988 | Lee et al. | |
| 4,984,027 | A | 1/1991 | Derimiggio et al. | |
| 5,450,183 | A | 9/1995 | O'Leary | |
| 6,016,409 | A | 1/2000 | Beard et al. | |
| 6,224,987 | B1 | 5/2001 | Yahagi | |
| 6,643,490 | B2 * | 11/2003 | Regimbal | 399/329 |
| 7,684,740 | B2 * | 3/2010 | Matsuda et al. | 399/301 |
| 2005/0002704 | A1 * | 1/2005 | Nakamura et al. | 399/341 |
| 2009/0087202 | A1 | 4/2009 | Hurst et al. | |
| 2009/0154943 | A1 | 6/2009 | Ciaschi et al. | |
| 2010/0178085 | A1 * | 7/2010 | Keenan et al. | 399/323 |

FOREIGN PATENT DOCUMENTS

| | | | |
|---|---|---|---|
| JP | 2004 093759 | A | 3/2004 |
| JP | 2004 233837 | A | 8/2004 |

* cited by examiner

*Primary Examiner* — David Gray
*Assistant Examiner* — Gregory H Curran
(74) *Attorney, Agent, or Firm* — Donna P. Suchy

(57) ABSTRACT

A fuser and receiver release system and method are provided for improving the release of receivers in high speed of printing systems. This system controls the release of a receiver in conjunction with a fuser in a printing system, and specifically the efficiency and accuracy of the release system. One embodiment of this method includes a belt fuser that allows the separating of the heat transfer and release functions of the fuser such that fuser roller could be made of hard metal core that can be heated to high temperatures without the fear of delaminating elastomeric coatings which are common in roller fusing.

8 Claims, 4 Drawing Sheets

HIGH GLOSS (IE. GLOSSER)

MEDIUM GLOSS (IE. ROLLER FUSER-LIKE)
$0 < \alpha < 180$

FUSING APPARATUS FOR HIGH SPEED ELECTROPHOTOGRAPHY SYSTEM

FIELD OF THE INVENTION

The invention relates generally to the field of printing, and more particularly to processes and apparatus for maintaining quality in digital reproduction systems by controlling the fuser used in the electrostatographic printing process.

BACKGROUND OF THE INVENTION

In electrostatographic imaging and recording processes such as electrophotographic reproduction, an electrostatic latent image is formed on a primary image-forming member such as a photoconductive surface and is developed with a thermoplastic toner powder to form a toner image. The toner image is thereafter transferred to a receiver, e.g., a sheet of paper or plastic, and the toner image is subsequently fused to the receiver in a fusing station using heat or pressure, or both heat and pressure. The fuser station can include a roller, belt, or any surface having a suitable shape for fixing thermoplastic toner powder to the receiver.

The fusing step in a roller fuser commonly consists of passing the toned receiver between a pair of engaged rollers that produce an area of pressure contact known as a fusing nip. In order to form the fusing nip, at least one of the rollers typically has a compliant or conformable layer on its surface. Heat is transferred from at least one of the rollers to the toner in the fusing nip, causing the toner to partially melt and attach to the receiver. In the case where the fuser member is a heated roller, a resilient compliant layer having a smooth surface is typically used which is bonded either directly or indirectly to the core of the roller. Where the fuser member is in the form of a belt, e.g., a flexible endless belt that passes around the heated roller, it typically has a smooth, hardened outer surface.

Most roller fusers, known as simplex fusers, attach toner to only one side of the receiver at a time. In this type of fuser, the roller that contacts the unfused toner is commonly known as the fuser roller and is usually the heated roller. The roller that contacts the other side of the receiver is known as the pressure roller and is usually unheated. Either or both rollers can have a compliant layer on or near the surface. In most fusing stations having a fuser roller and an engaged pressure roller, it is common for only one of the two rollers to be driven rotatably by an external source. The other roller is then driven rotatably by frictional contact.

In a duplex fusing station, which is less common, two toner images are simultaneously attached, one to each side of a receiver passing through a fusing nip. In such a duplex fusing station there is no real distinction between fuser roller and pressure roller, both rollers performing similar functions, i.e., providing heat and pressure.

Two basic types of simplex heated roller fusers have evolved. One uses a conformable or compliant pressure roller to form the fusing nip against a hard fuser roller, such as in a DocuTech 135 machine made by the Xerox Corporation. The other uses a compliant fuser roller to form the nip against a hard or relatively non-conformable pressure roller, such as in a Digimaster 9110 machine made by Eastman Kodak Company. A fuser roller designated herein as compliant typically includes a conformable layer having a thickness greater than about 2 mm and in some cases exceeding 25 mm. A fuser roller designated herein as hard includes a rigid cylinder, which may have a relatively thin polymeric or conformable elastomeric coating, typically less than about 1.25 mm thick.

A compliant fuser roller used in conjunction with a hard pressure roller tends to provide easier release of a receiver from the heated fuser roller, because the distorted shape of the compliant surface in the nip tends to bend the receiver towards the relatively non-conformable pressure roller and away from the much more conformable fuser roller.

A conventional toner fuser roller includes a cylindrical core member, often metallic such as aluminum, coated with one or more synthetic layers, which typically include polymeric materials made from elastomers.

One common type of fuser roller is internally heated, i.e., a source of heat for fusing is provided within the roller for fusing. Such a fuser roller normally has a hollow core, inside of which is located a heating source, usually a lamp. Surrounding the core is an elastomeric layer through which heat is conducted from the core to the surface, and the elastomeric layer typically contains fillers for enhanced thermal conductivity. A different kind of fuser roller that is internally heated near its surface is disclosed by Lee et al. in U.S. Pat. No. 4,791,275, which describes a fuser roller including two polyimide Kapton® sheets (sold by DuPont® and Nemours) having a flexible ohmic heating element disposed between the sheets. The polyimide sheets surround a conformable polyimide foam layer attached to a core member. According to J. H. DuBois and F. W. John, Eds., in Plastics, 5th Edition, Van Nostrand and Rheinhold, 1974, polyimide at room temperature is fairly stiff with a Young's modulus of about 3.5 GPa-5.5 GPa (1 GPa=1 GigaPascal=10.sup.9 Newton/m.sup.2), but the Young's modulus of the polyimide sheets can be expected to be considerably lower at the stated high operational fusing temperature of the roller of at least 450 degrees F.

An externally heated fuser roller is used, for example, in an Image Source 120 copier, and is heated by surface contact between the fuser roller and one or more external heating rollers. Externally heated fuser rollers are also disclosed by O'Leary, U.S. Pat. No. 5,450,183, and by Derimiggio et al., U.S. Pat. No. 4,984,027.

A compliant fuser roller may include a conformable layer of any useful material, such as for example a substantially incompressible elastomer, i.e., having a Poisson's ratio approaching 0.5. A substantially incompressible conformable layer including a poly (dimethyl siloxane) elastomer has been disclosed by Chen et al., in the commonly assigned U.S. Pat. No. 6,224,978, which is hereby incorporated by reference. Alternatively, the conformable layer may include a relatively compressible foam having a value of Poisson's ratio much lower than 0.5. A conformable polyimide foam layer is disclosed by Lee in U.S. Pat. No. 4,791,275 and a lithographic printing blanket are disclosed by Goosen et al. in U.S. Pat. No. 3,983,287, including a conformable layer containing a vast number of frangible rigid-walled tiny bubbles that are mechanically ruptured to produce a closed cell foam having a smooth surface.

Receivers remove the majority of heat during fusing. Since receivers may have a narrower length measured parallel to the fuser roller axis than the fuser roller length, heat may be removed differentially, causing areas of higher temperature or lower temperature along the fuser roller surface parallel to the roller axis. Higher or lower temperatures can cause excessive toner offset (i.e., toner powder transfer to the fuser roller) in roller fusers. However, if differential heat can be transferred axially along the fuser roller by layers within the fuser roller having high thermal conductivity, the effect of differential heating can be reduced.

Improved heat transfer from the core to the surface of an internally heated roller fuser will reduce the temperature of the core as well as that of mounting hardware and bearings that are attached to the core. Similarly, improved heat transfer to the surface of an externally heated fuser roller from external heating rollers will reduce the temperature of the external heating rollers as well as the mounting hardware and bearings attached to the external heating rollers.

In the fusing of the toner image to the receiver, the area of contact of a conformable fuser roller with the toner-bearing surface of a receiver sheet as it passes through the fusing nip is determined by the amount pressure exerted by the pressure roller and by the characteristics of the resilient conformable layer. The extent of the contact area helps establish the length of time that any given portion of the toner image will be in contact with, and heated by, the fuser roller.

A fuser module is disclosed by M. E. Beard et al., in U.S. Pat. No. 6,016,409, which includes an electronically-readable memory permanently associated with the module, whereby the control system of the printing apparatus reads out codes from the electronically readable memory at install to obtain parameters for operating the module, such as maximum web use, voltage and temperature requirements, and thermistor calibration parameters.

In a roller fusing system, the fusing parameters, namely the temperature, nip-width, and speed of the fusing member, are fixed and controlled within certain specifications for a given range of receivers. Generally the system changes the temperature or/and speed according to the receiver weights or types. The changing of temperature in an internally heated fuser roller takes time to stabilize. If the receivers are presented at a too-rapid rate, the fuser roller may not have returned to its working temperature when the next receiver arrives. Consequently, the receivers must be stopped or slowed until the temperature of the fuser roller has come within acceptable range and such stopping or slowing results in degradation of receiver throughput rate. The same is true for speed changes. Regardless of whether the speed of presentation or the fuser roller temperature itself is being adjusted by the system, the temperature stabilization time required by a fusing member can constrain the speed of presentation of receivers.

The fixing quality of toned images of an electrophotographic printer depends on the temperature, nip-width, process speed, and thermal properties of the fusing member, toner chemistry, toner coverage, and receiver type. To simplify the engineering and control of a roller fusing system, as many as possible of the above parameters are considered and then fixed during the system's design. The fusing parameters such as temperature, nip-width, process speed, and thermal properties of the fusing member are optimized for the most critical case.

Complicating the system's design is the fact that the toner coverage and the receiver type (weight, coated/uncoated) can vary from image to image in a digital printer. Therefore, some of the above listed parameters need to be adjusted according to the image contents and the receiver types to assure adequate image fixing. Typically, the fuser temperature is adjusted and kept constant for a dedicated run with a particular receiver. The temperatures are adjusted higher from the nominal, for heavier receivers and lower for lighter receivers. For some heavy receivers, the speed must also be reduced.

The change of fuser temperature and/or reduction of speed results in reduced productivity. Furthermore, if different receiver types are required in a single document, extra time is needed to collate images on different receivers into the document.

The receiver released is often a problem in high speed printers. In the prior art one mechanism used to facilitate the separation of a fused image from a heated fusing surface, such as that provided by heated rollers, was to cover the rollers with some sort of elastomeric layer and topped with a low surface energy polymeric coating. In other instances a mechanical or high pressure air skives was used to assist the release of the media from the fusing surface. These methods have disadvantages for example the contact skives can leave streaking artifacts on the image and air skives require a large supply of forced air. The main drawback of these methods is that a roller fuser configuration that has an elastomer layer on the fuser roller forms a nip that effectively acts as a thermal barrier.

In order to facilitate higher heat transfer required at increasing print engine speeds there is a need for the elastomer covering on the fuser roller to be minimized as compared to the backup roller. This creates a situation where the media separation from the fuser roller surface becomes more difficult. In other words the requirements for the heat transfer and the nip shape for a better release of media from an internally heated fuser roller compete against each other. Unfortunately often improving the heat transfer deteriorates the media release from the fusing surface of internally heated roller fusers.

On the contrary, in externally heated fusers the media release issue has been solved by providing a softer (or thicker) layer of elastomer on the fuser roller relative to the backup roller. Since the heat for externally heated rollers is provided by external means, thicker fuser roller coatings are used to provide a larger nip for the external heating roller thus increasing the contact time and the heat flow. Most commonly with heated metal rollers, high-speed printing creates a difficult problem because the high temperature and high stress employed by the heating rollers to the top soft release layer of the fuser roller may reduce its useful life. Also some roller fusers are a combination of both internal and external heating types described above.

There is a need to solve various problems that will result in improved media separation from the fusing surface (belt) without requiring forced air to release the media. One of these problems is supplying enough heat to fuse an image in the higher speed printers. The following invention solves this problem in a wide variety of situations.

SUMMARY OF THE INVENTION

In accordance with an object of the invention, both a system and a method are provided for improving the controlled release of a receiver in conjunction with a fuser in a printing system, and specifically the efficiency and accuracy of the release system. One embodiment of this method includes a belt fuser that allows the separating of the heat transfer and release functions of the fuser such that fuser roller could be made of hard metal core that can be heated to high temperatures without the fear of delaminating elastomeric coatings which are common in roller fusing. The release is achieved by bending the fuser belt around a smaller release roller after the fuser nip between the rollers. Media stiffness will make the media to separate from the belt at a sharp bend at roller. Furthermore additional heat can be provided by an external heat source such as heated roller.

While the specification concludes with claims particularly pointing out and distinctly claiming the subject matter of the present invention, it is believed the invention will be better understood from the following detailed description when taken in conjunction with the accompanying drawings.

BRIEF DESCRIPTION OF THE DRAWINGS

For a better understanding of the characteristics of this invention the invention will now be described in detail with reference to the accompanying drawings, wherein.

DETAILED DESCRIPTION OF THE INVENTION

The present description will be directed in particular to elements forming part of, or cooperating more directly with, apparatus and methods in accordance with the present invention. It is to be understood that elements not specifically shown or described may take various forms well known to those skilled in the art.

Various aspects of the invention are presented in FIGS. 1-4 which are not drawn to scale and in which like components are numbered alike. According to one aspect of the invention, the thermal response of the fuser with sheets being fed through the fuser is simulated in the fuser prior to feeding sheets through the fuser. The thermal response may be simulated in a manner that minimizes thermal droop, or it may be simulated in a manner that maintains a nip force, or it may be simulated in a manner that accomplishes both. According to a further aspect of the invention, the thermal response of the fuser with sheets being fed through the fuser is controlled to maintain a desired tentering force. The desired tentering force may be varied based on sheet width, or sheet heat absorbing capacity, or sheet stiffness, or combinations of these (all combinations thereof being included within the purview of the invention).

Figure 1:
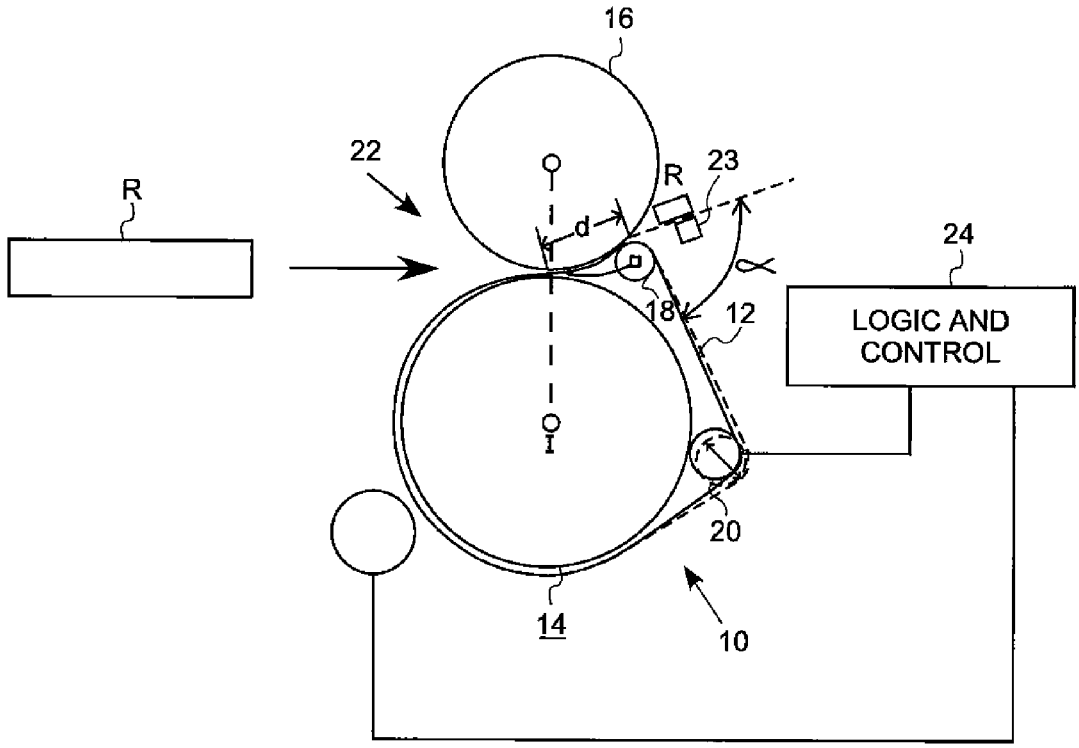
FIG. 1 is a schematic illustration of a printer system according to the present invention for use in conjunction with an image control system and method.

The fuser release system 10 shown in FIG. 1 employs a movable fusing element 12, such as a fusing belt, as a fusing element (example NexGlosser) in contact with a fusing roller 14 which makes a nip with a pressure roller 16. The belt fusing element 12 that is shown has an advantage since it allows the separation of the heat transfer and media release functions but other types could be used. The movable fuser element 12 is entrained around the 25 internally heated fuser roller 14, a release roller 18 (NEW3), and a tension steering roller 20 (NEW 4) as shown in FIG. 1 so that the receiver R will pass through a nip 22. The heat transfer is accomplished mainly in the nip 22 formed by the internally heated metal fuser roller 14 and a backup pressure roller 16 which is covered with a thick layer 15 of elastomeric material to provide a large 30 and variable nip 22. The image is fixed under a heated pressurized nip just like an internally heated roller fuser but the paper release is achieved by bending the belt against a smaller release roller 18 that creates an excellent release geometry defined by an angle ($\alpha$) relative to the paper feed as measured from a line through the center of the heated fuser roller 14 and the pressure roller 16 and the belt 12 as shown in FIG. 1. This angle is dependent on the specifics of the printer and paper as well as the toner composition as well as the desired output, such as degree of gloss.

FIG. 1 shows the fuser release system 10 including a fuser release sensor 23, which inputs to a logic and control system 24, also referred to as a Logic Control Unit (LCU), that controls the various aspects of the fuser release system 10, such as a heat sensor that can control heating of the fuser roller heater 16 or another sensor to help adjust the position of the release roller and also the steering roller, also referred to as a tension roller, 20. The fuser release system 10 can take on a number of positions that will be discussed below. The fuser roller 14 and the pressure roller 16 form the nip 22. A receiving sheet, also referred to as a receiver, R is considered to have entered the fuser release system 10 when it has entered the nip 22. The heater may be electrothermal, radiative, convective, or other heat sources suitable for fusing images, internal or external to the fuser roller, the particular type of heat source not being critical in the practice of the invention.

Figure 2:
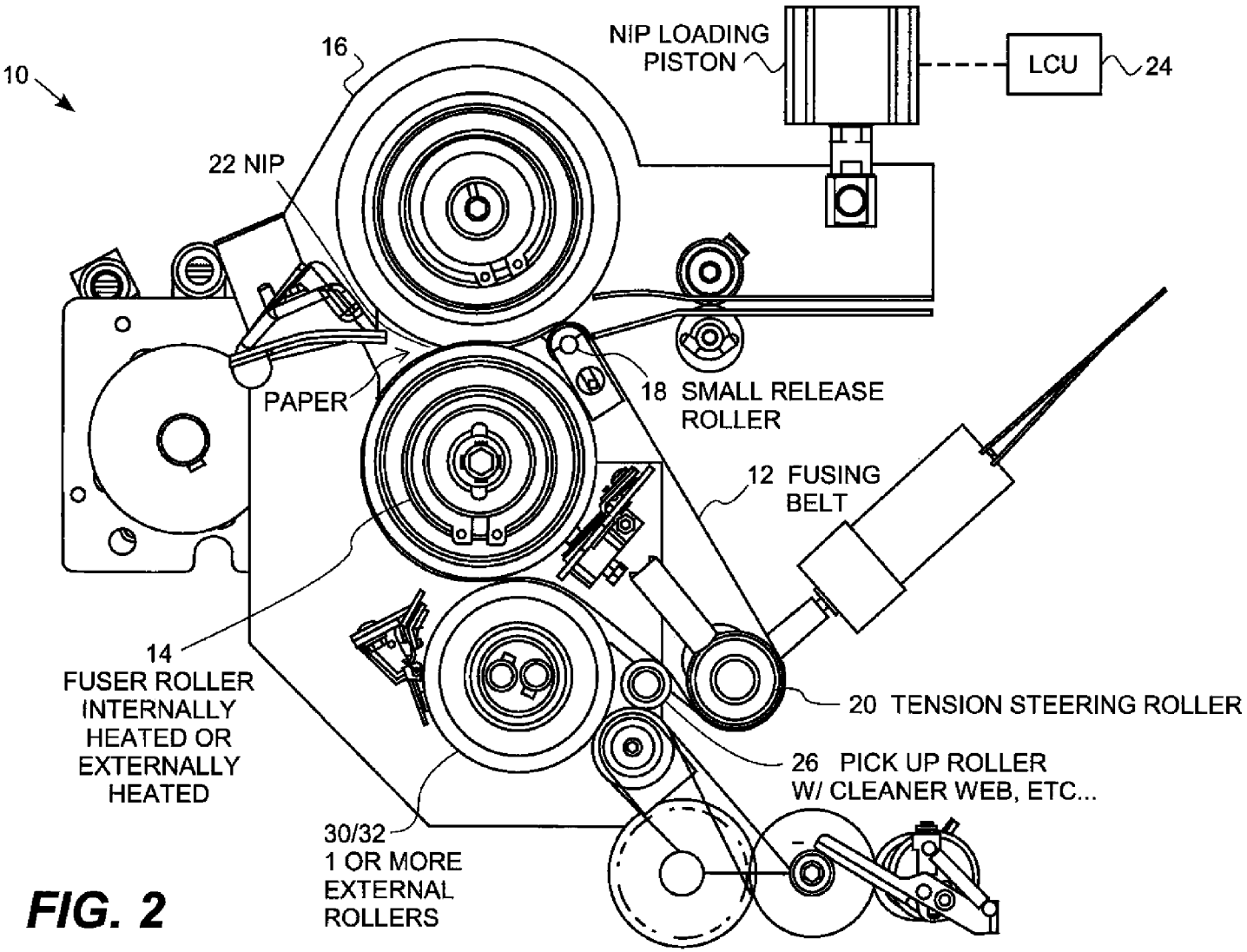
FIG. 2 is a schematic diagram of the fuser assembly according to this invention.

FIG. 2 shows one embodiment of the fusing system 10. This invention employs a fusing element, shown here as a fusing belt 12 (example NexGlosser). The belt fusing element has an advantage since it allows the separation of the heat transfer and media release functions. The fusing belt 12 is entrained around the internally heated fuser roller 14, release roller 18 and a steering roller 20 as shown in FIG. 1.

Figure 5:
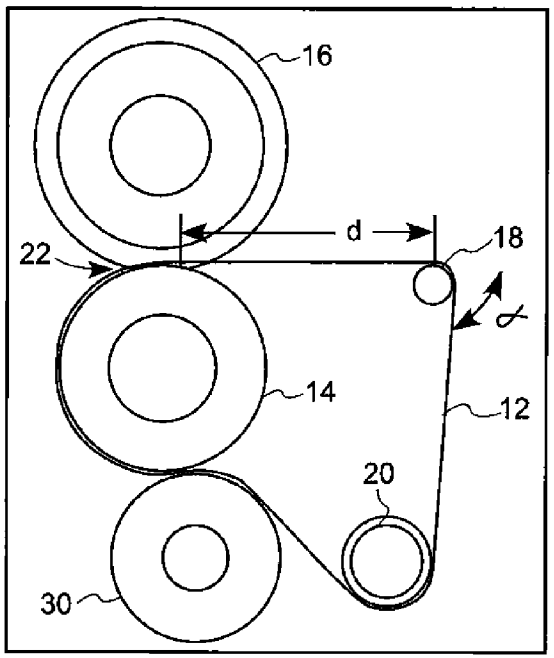
FIG. 5 is a schematic diagram showing another embodiment of the system.
Figure 4:
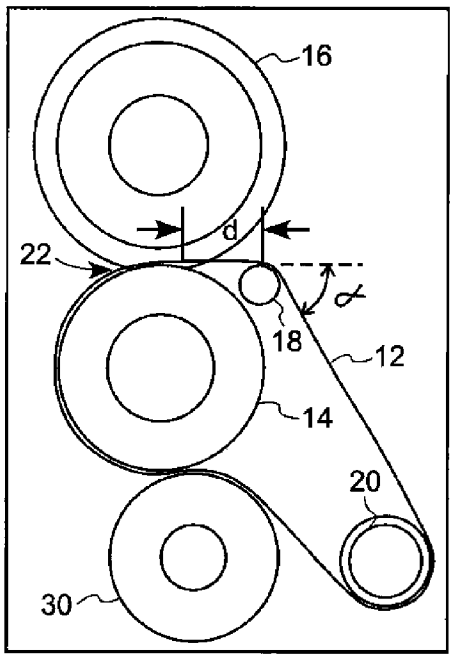
FIG. 4 is a schematic diagram showing another embodiment of the system.
Figure 3:
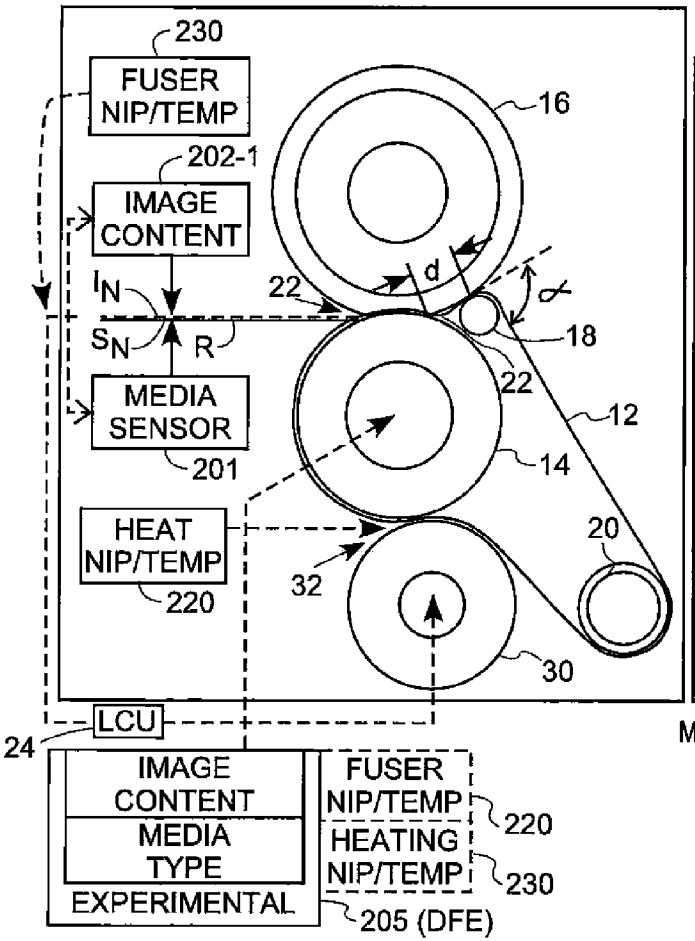
FIG. 3 is a schematic diagram showing an embodiment of the fusing system.

FIG. 3 shows one embodiment of the fuser system. In FIG. 3 the heat transfer is accomplished mainly in the nip 22 formed by a heated metal fuser roller 14 and a backup pressure roller 16 forming the nip 22. The image is fixed under a heated pressurized nip just like an internally heated roller fuser but the paper release is achieved by bending the belt against a smaller release roller 18 that creates an excellent release geometry defined by an angle ($\alpha$). In FIG. 3 the angle ($\alpha$) is between 0 and 180 degrees and the release roller 18 is in contact with the back-up roller 16. The angle ($\alpha$) is defined as the angle between a tangent created by extending the paper path line toward the release roller 18 and the line between the release roller and the steering roller 20 as shown in FIG. 3 and FIGS. 4 and 5 below. If the media types that usually experience a common problem, such as curl, are recorded in memory then the angle ($\alpha$) that can control this curl can be also added to a table and coupled with the media type to allow the fuser to automatically adjust angle ($\alpha$) for different receiver types.

The release geometry allows the media to separate due to its own stiffness from the fusing belt surface 12. The release roller 18 also provides an extended lower pressure contact after the media exits the main fuser nip. In one embodiment the internally heated fuser roller 14 is of conductive metal (aluminum, steel etc.) without any elastomer covering. The fuser roller can be heated to quite high temperatures without the fear of delaminating/degradation of such elastomeric layer. Further heat can be provided to the fusing belt by external means such as radiant heating lamps or one or more metal heating rollers 30 as is shown in the FIG. 3. The advantage of one or more external heating rollers 30 is that it provides a large low pressure contact area that does not harm the top release layer of the fusing belt. The external heating members are, in one embodiment, movable rollers so that the contact is variable to provide variable heat transfer.

The fuser release system offers many advantages that make high quality printing at speeds higher than 200 PPM as well as an excellent media release for a wide range of receiver media without the aid of mechanical or air skives and this can be obtained at a lower cost and higher life of fusing belt as compared to the fusing rollers. It can also be internally heated with a lamp and can have a diameter between 50-150 mm. The release roller 18 in another embodiment has a roller diameter between 15 to 80 mm and is moveable.

The fusing belt 12 shown has a base made of a metal, such as steel, aluminum, nickel, copper or similar heat conductive metals or even heat resistant plastics, such as polyimide or alike. It can be seamless or welded. It also has an intermediate coating that is a conductive elastomer 0.1 to 1.0 mm thick.

Finally it has a topcoat made of low surface energy polymer such as pfa, pfe, ptfe, flc etc. that is 10 to 50 um thick. Also shown along with the steering roller 20 is a cleaning web and roller assembly 26 (See FIG. 2). The externally heated roller 30 can also be used an annealing roller if it is moved to be in contact with roller 14 and/or the fusing belt. Such an annealing roller would be made from polished aluminum or steel and internally heated. In one embodiment it would have a diameter of 20 to 50 mm. The system must be able to move so that it can engage or disengage with out a belt present. The method of annealing would include selectively moving heating roller (30) into contact with the roller 14 and increasing the temperature to an annealing temperature to refurbish the fuser in one embodiment.

Note that the external heating function can also be accomplished by other means such as radiant lamp etc. Finally the backup roller 16 can be made from an aluminum core that is 50-150 mm in diameter. One preferred embodiment uses back-up roller that is 100 mm diameter. The roller has soft and thick elastomeric coating to provide large nip. The coating thickness can be 1-15 mm. One preferred embodiment uses a 10 mm thick soft elastomer.

The belt fuser 12 allows the separating of the heat transfer and release functions of the fuser such that fuser roller could be made of hard metal core that can be heated to high temperatures without the fear of delaminating elastomeric coatings which are common in roller fusing. The release is achieved by bending the fuser belt around a smaller release roller 18 after the fuser nip between rollers 14 and 16. Media stiffness will make the media to separate from the belt at a sharp bend at roller 18. Furthermore additional heat can be provided by an external heat source such as heated roller 28. This advantage is important in high speed printing systems because of the need for high fusing temperatures. It is also useful when large quantities of toner are laid down to give special effects such as in raised print or extra gloss coverings.

Each controller may include a cam and a stepper motor for a fixed displacement nip, a pneumatic controlled tension device, a set of air regulated cylinders for constant load nip, a combination of both, or any combination of these and other electromechanical mechanisms well-known in the art. Since the tension of the steering roller as well as other things, such as a temperature of the using roller (as driven by the heating rollers nip) and the nipwidth between the fusing and pressure members can be manipulated and adjusted for each sheet, such a fusing assembly system allows mixing of many different media weights and types seamlessly without any restriction on the run length of each media. In distinct embodiments of the invention, the fusing member may be in the form of a roller, a belt or a sleeve, or variations thereof as are well known in the art. In a further embodiment of the invention a cleaning web 56 may be placed in contact with any of the rollers. The invention confers the advantage of enabling the printer to run jobs in document mode while mixing a variety of receivers, without loss of productivity or fusing quality. The invention also facilitates seamless printing on the widest possible ranges of media types and weights.

FIG. 4 shows another embodiment of the fuser system. The release roller is shown in a position away from the back-up roller 16 and this allows the fuser release system to control various receiver related concerns, such as paper curl, that can be induced in certain types of media and fusing nip shapes. The distance "d" represents a distance from the end of the nip 22 to the release roller where it makes contact with the fusing belt 12. This distance "d" can be controlled based on to handle a number of fuser related image quality characteristics. In addition the fuser release system allows an angle ($\alpha$) to be changed. Like FIG. 3, the embodiment shown in FIG. 4 can be used for a variety of media types, such as lighter media types, such as when curl is a problem.

FIG. 5 shows another embodiment of the fuser release system where the distance "d" is greater then shown in FIG. 4. When roller 18 is moved far from the nip and "d:" is increased, the system is able to provide a high gloss to the printed receiver. In this embodiment the system can impart a gloss surface. The control of the belt to gloss is described in commonly assigned applications U.S. Ser. No. 11/954,444, entitled: "ON DEMAND FUSER AND RELATED METHOD" and U.S. Ser. No. 12/323,495, entitled: EXTERNALLY HEATED FUSER DEVICE WITH EXTENDED NIP WIDTH which are both incorporated by reference herein. A media type and desired gloss can be input into a table of set points for various media types and the resulting location of the release roller 18 and the tension steering roller 20 necessary to achieve this desired result is automatically derived based on the table that used distance "d". This allows a dialable gloss level for all paper types, even those that are currently not able to be printed on with conventional printers. A data set can be used in conjunction with this embodiment, for example as a fourth data set, that includes a distance "d", that is retrieved from a set of stored set points for "d" in a table and that is matched with a matched temperature and media type that together produce a high gloss or variable gloss based on the contact time and temperature applied to the printed image. This date is stored in a table in the DFE, such as in a substrate catalogue, and is used as a gloss control based on substrate type and fuser temperature. These matched sets can be determined empirically or calculated.

Figure 6:
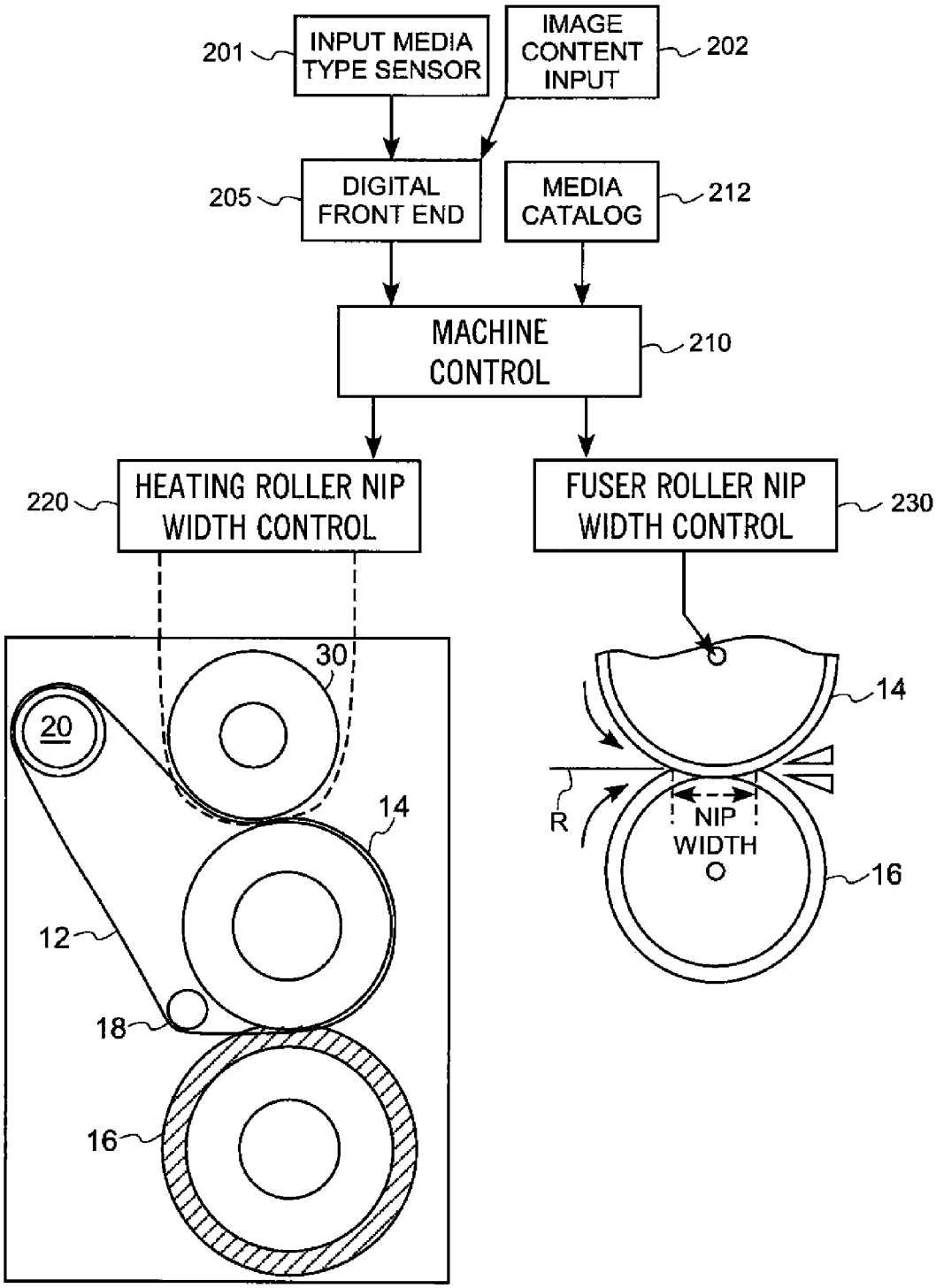
FIG. 6 is a schematic diagram showing another embodiment of the system.

In one embodiment as shown in FIG. 6, a sheet $S_n$ bears a toner image $I_n$. The toner content of the image and the type of media that receives the image are provided to the digital front end 205 (hereafter referred to as DFE) associated with the printer. The digital front end 205 and media catalog 212, including a table of angles or angle table discussed above, which provides the printer machine control 210 with signals representing respectively image content, and type of media and parameters of such media type being used. For quality control purposes, the apparatus has a media sensor 201 that senses the type and weight of the sheet $S_n$ and an image content sensor 202 senses the amount of toner that forms the image $I_n$. The heating roller controller 220, associated with the machine control 210, controls the nips 22 and 32 between heating rollers 16 and 30 to the fusing roller 14 respectively, as well as the temperature of each heating roller. The fuser roller nip width controller 230, associated with the machine control 210, controls the distance "d" and the angle ($\alpha$) by using the steering roller 20. The fuser assembly according to this invention adjusts the release roller 18 by changing the position of the rollers 18, 20 and thus the release angle ($\alpha$).

The fuser assembly according to this invention also applies print engine intelligence as referred to above. The fuser process set points (fuser nip width, fuser member temperature, and energy requirements) for various types of media are stored as lookup tables in a media catalog 212 for the machine control unit 210 (see FIG. 4) and these are used to control the fuser as well as the release apparatus and system. The media can include heavy stock cover material, interior page print material, insert material, transparency material, or any other desired media to carry text or image information. A typical machine control unit 210 includes a microprocessor and memory or microcomputer. It stores and operates a program that controls operation of the machine in accordance with programmed steps and machine inputs, such as temperature of the fusing rollers. Temperature data is supplied, for example, by a thermocouple (not shown) or any other suitable thermal sensor in a manner well known to those skilled in the art. As a sheet of a specific media type is requested, the DFE 205 provides a data signal to the machine control unit 210 (or alternatively, directly to an independent control for the fuser assembly) that is representative of the image contents and the type of media sheet coming to be fixed. The machine control unit 210 sets the fuser conditions (temperature; dwell time) from the media catalog 212 as a function of the data provided by the DFE 205. Machine control unit 210 directs the heating roller nip width control 220 for heating rollers to adjust the nip width according to the power requirements for heating the fuser belt per the information provided from media catalog 212. Machine control unit 210 also directs the fuser roller nip width controller 230 for fusing roller 14 and pressure roller 16 to adjust the fuser nip per the information provided from media catalog 212.

The invention has been described in detail with particular reference to certain preferred embodiment thereof, but it will be understood that variations and modifications can be effected within the spirit and scope of the invention.

What is claimed is:

1. Method for maintaining print quality based on temperature measurements for a fuser for fusing toner to sheets of receiver media in an electrostatographic printer, comprising for each dedicated run of a specified receiver media, the steps of:

a. providing a first data set, including set points representative of one or more media types;

b. providing a second data set representative of a particular type of arriving media as a current media type;

c. providing third data set representative of current thermal set-points related to a current set-up, including the current media type;

d. selectively adjusting a release system adjacent to a pressure member at a release angle $\alpha$ from a line through a fusing nip in accordance with at least one of the data sets using a controller for changing the release angle $\alpha$ in accordance with the type of receiver media and the image on the current media type e. selectively moving a heating roller into contact with the fuser and increasing the temperature to an annealing temperature to refurbish the fuser.

2. The method of claim 1, wherein a fourth data set, including a new distance "d", is stored in a media catalogue to be used as a gloss control based on media type and fuser temperature.

3. The method of claim 1, wherein the run comprises printing 50-250 sheets of receiver media, to reach a steady-state situation, is done before taking measurements on the release angle and storing these measurements in a media catalogue.

4. The method of claim 1, wherein the adjustment is made at a controlled rate of change and the controlled rate of change is optimized based on a set of rules that are chosen based on current process conditions.

5. The method of claim 1, further comprising: controlling temperature based on media type and fuser temperature.

6. The method of claim 1, the release system adjustment further comprising controlling a release roller adjacent a fusing belt using a tension steering roller.

7. The method of claim 6, wherein the release angel is kept between 1 and 180 degrees.

8. The method of claim 6, wherein the release angle and a distance "d" are varied according to stored data including media type, release roller characteristics including diameter and operating conditions and gloss requirements.

* * * * *